US012310439B2

(12) United States Patent
Yaremenko

(10) Patent No.: US 12,310,439 B2
(45) **Date of Patent: *May 27, 2025**

(54) GARMENT HAVING CUP POCKETS WITH CONCEALED OPENINGS

(71) Applicant: LULULEMON ATHLETICA CANADA INC., Vancouver (CA)

(72) Inventor: Yuliya Victorivna Yaremenko, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/632,292

(22) Filed: Apr. 11, 2024

(65) Prior Publication Data

US 2024/0251895 A1 Aug. 1, 2024

Related U.S. Application Data

(63) Continuation of application No. 17/681,829, filed on Feb. 27, 2022, now Pat. No. 11,957,194.

(60) Provisional application No. 63/159,643, filed on Mar. 11, 2021.

(51) Int. Cl.
*A41D 27/20* (2006.01)

(52) U.S. Cl.
CPC ..... *A41D 27/201* (2013.01)

(58) Field of Classification Search
CPC ..... A41D 27/201; A41D 27/205; A41D 7/00; A41C 3/00; A41C 3/0035
See application file for complete search history.

(56) References Cited

U.S. PATENT DOCUMENTS

| | | | | | |
|---|---|---|---|---|---|
| 3,311,113 | A * | 3/1967 | Sayers | A41C 3/00 | 450/1 |
| 5,395,280 | A * | 3/1995 | Greenberg | A41C 3/148 | 450/55 |
| 6,443,805 | B1 * | 9/2002 | Kirkwood | A41C 3/08 | 450/57 |
| 6,517,410 | B1 * | 2/2003 | Underhill | A41C 3/0057 | 450/1 |
| 7,396,274 | B2 * | 7/2008 | Wiegmann | A41D 1/22 | 2/73 |
| 7,585,200 | B1 * | 9/2009 | McLaren | A41C 3/0035 | 450/1 |
| 8,484,763 | B1 * | 7/2013 | Lucas | A41C 3/0057 | 2/89 |
| 9,781,954 | B1 * | 10/2017 | Osetek | A41C 3/0057 | |
| 9,943,120 | B1 * | 4/2018 | Rendone | A41C 3/0057 | |
| 2007/0021034 | A2 * | 1/2007 | Barbour | A41D 15/005 | 450/1 |
| 2008/0070477 | A1 * | 3/2008 | Barbour | A41D 15/005 | 450/91 |
| 2011/0092134 | A1 * | 4/2011 | Alva | A61M 1/062 | 450/39 |

(Continued)

*Primary Examiner* — Jillian K Pierorazio
(74) *Attorney, Agent, or Firm* — CONNEELY PC; Joseph Conneely

(57) ABSTRACT

Examples of a garment, such as a bra or sports bra, having cup pockets with concealed openings are described. The garment has openings into the cup pockets that are positioned on the side wings of the front portion of the garment. The side wings of the back portion of the garment and the side wings of the front portion of the garment at least partially overlap to conceal or hide the openings into the cup pockets.

20 Claims, 14 Drawing Sheets

(56) References Cited

U.S. PATENT DOCUMENTS

| | | | | |
|---|---|---|---|---|
| 2011/0223832 | A1* | 9/2011 | Rose | A41C 3/08 450/86 |
| 2013/0143469 | A1* | 6/2013 | Grippaudo | A41C 3/0035 450/3 |
| 2015/0007379 | A1* | 1/2015 | Cockram | A41D 13/0015 2/236 |
| 2016/0206013 | A1* | 7/2016 | Marshall | A41C 3/005 |
| 2017/0127731 | A1* | 5/2017 | Flower | A41C 3/0057 |
| 2017/0332704 | A1* | 11/2017 | Fontaine | A41B 17/00 |
| 2018/0160751 | A1* | 6/2018 | Epp Frenette | A45F 5/02 |
| 2018/0220718 | A1* | 8/2018 | Wade | A41B 1/08 |
| 2018/0325193 | A1* | 11/2018 | Griffiths | A41C 3/144 |
| 2020/0085113 | A1* | 3/2020 | Rendone | A41C 3/10 |
| 2022/0039486 | A1* | 2/2022 | Pennington | A41C 3/0035 |
| 2022/0287400 | A1 | 9/2022 | Yaremenko | |
| 2023/0022456 | A1* | 1/2023 | Voorhees | A41D 1/04 |

* cited by examiner

Section A-A

GARMENT HAVING CUP POCKETS WITH CONCEALED OPENINGS

This application is a continuation of U.S. patent application Ser. No. 17/681,829, filed Feb. 27, 2022, which claims priority from and the benefit of the filing date of U.S. Provisional Patent Application No. 63/159,643, filed Mar. 11, 2021, and the entire content of such applications is incorporated herein by reference.

FIELD

This application relates to the field of sports apparel, and more specifically, to a garment such as a bra or sports bra or the like having cup pockets with concealed or hidden openings.

BACKGROUND

Consumers are demanding high performance activewear and sportswear. Currently, many such garments, such as sports bras, require frequent adjustment and have cup pockets that do not adequately secure inserts when the wearer is engaged in stretching, exercising, and athletic performance. Typically, sportswear should be snug but also needs to provide adequate room for holding items such cup pocket inserts. At the same time, such garments should remain flexible to keep wearers comfortable during stretching, exercising, and other athletic performance.

SUMMARY OF THE APPLICATION

In one aspect, a garment, such as a bra or sports bra, having cup pockets with concealed openings is provided. The garment has openings into the cup pockets that are positioned on the side wings of the front portion of the garment. The side wings of the back portion of the garment and the side wings of the front portion of the garment at least partially overlap to conceal or hide the openings into the cup pockets.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the application. Sizes and relative positions of elements in the drawings are not necessarily drawn to scale. For example, the shapes of various elements and angles may be not drawn to scale, and some of these elements may be arbitrarily enlarged and positioned to improve drawing legibility.

DETAILED DESCRIPTION

In the following description, details are set forth to provide an understanding of the application. In some instances, certain structures, techniques, and methods have not been described or shown in detail in order not to obscure the application.

Figure 1:
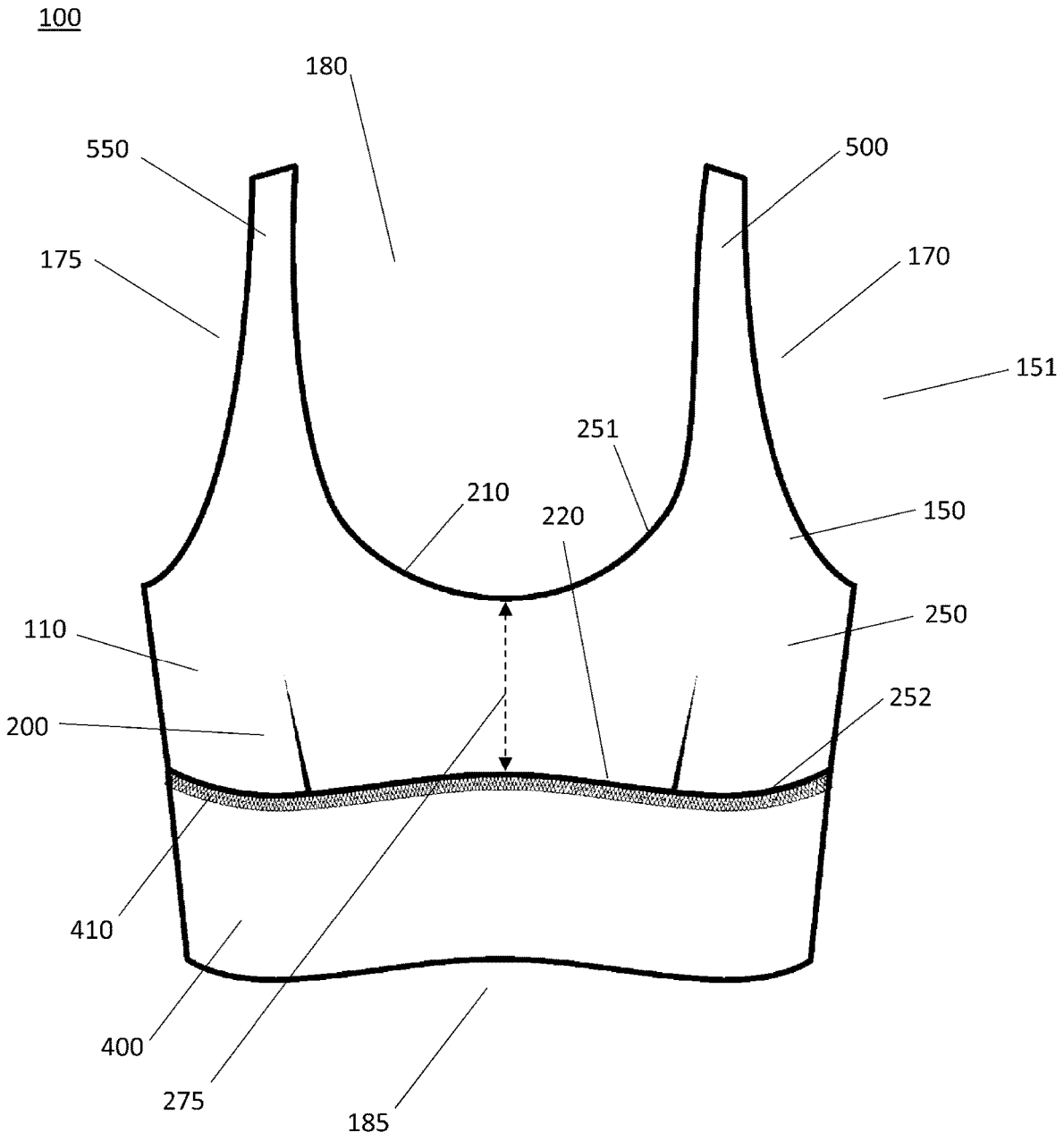
FIG. 1 is an outside front view illustrating an example garment having cup pockets with concealed or hidden pocket openings.
Figure 2:
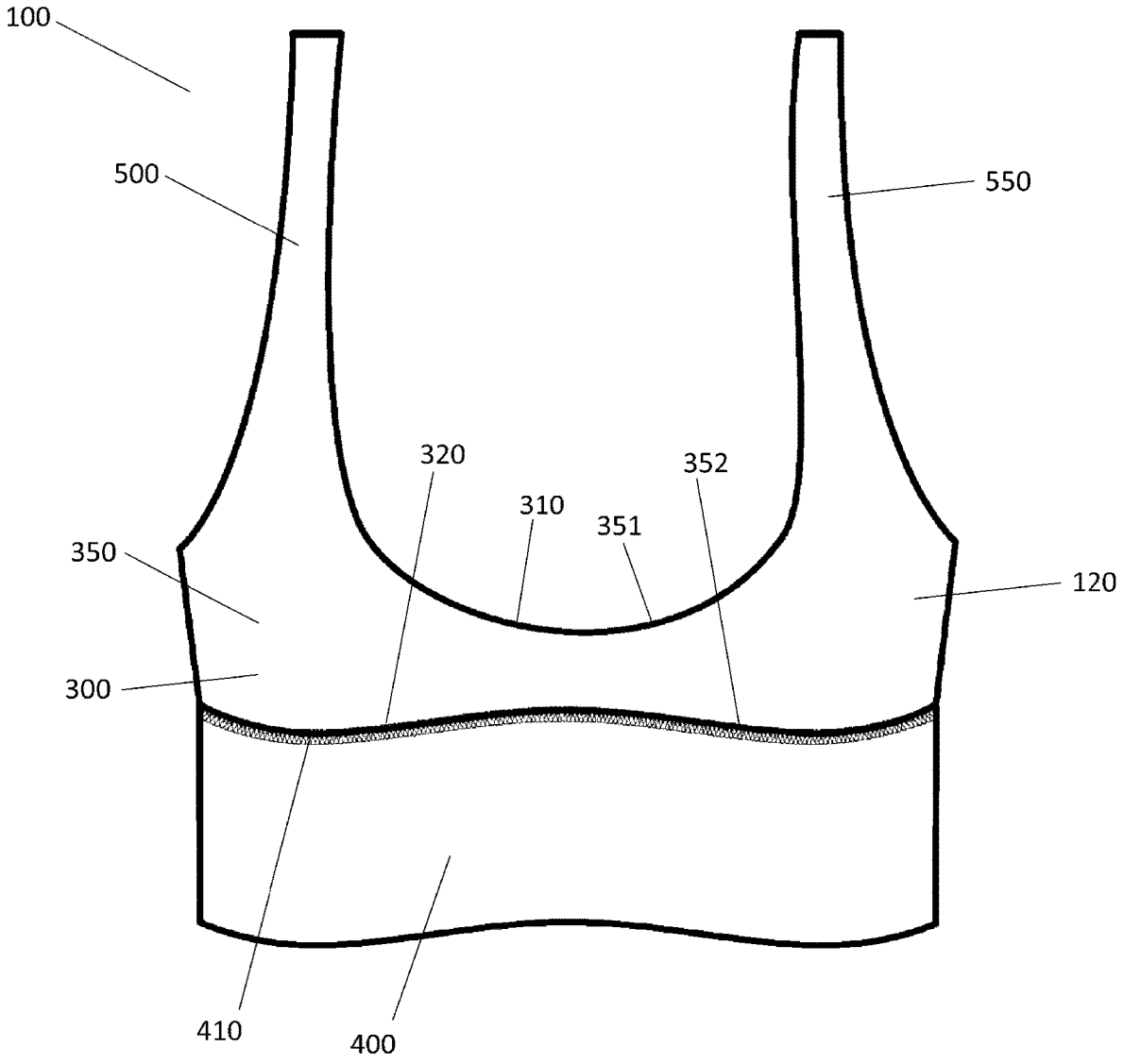
FIG. 2 is a rear view thereof.
Figure 3:
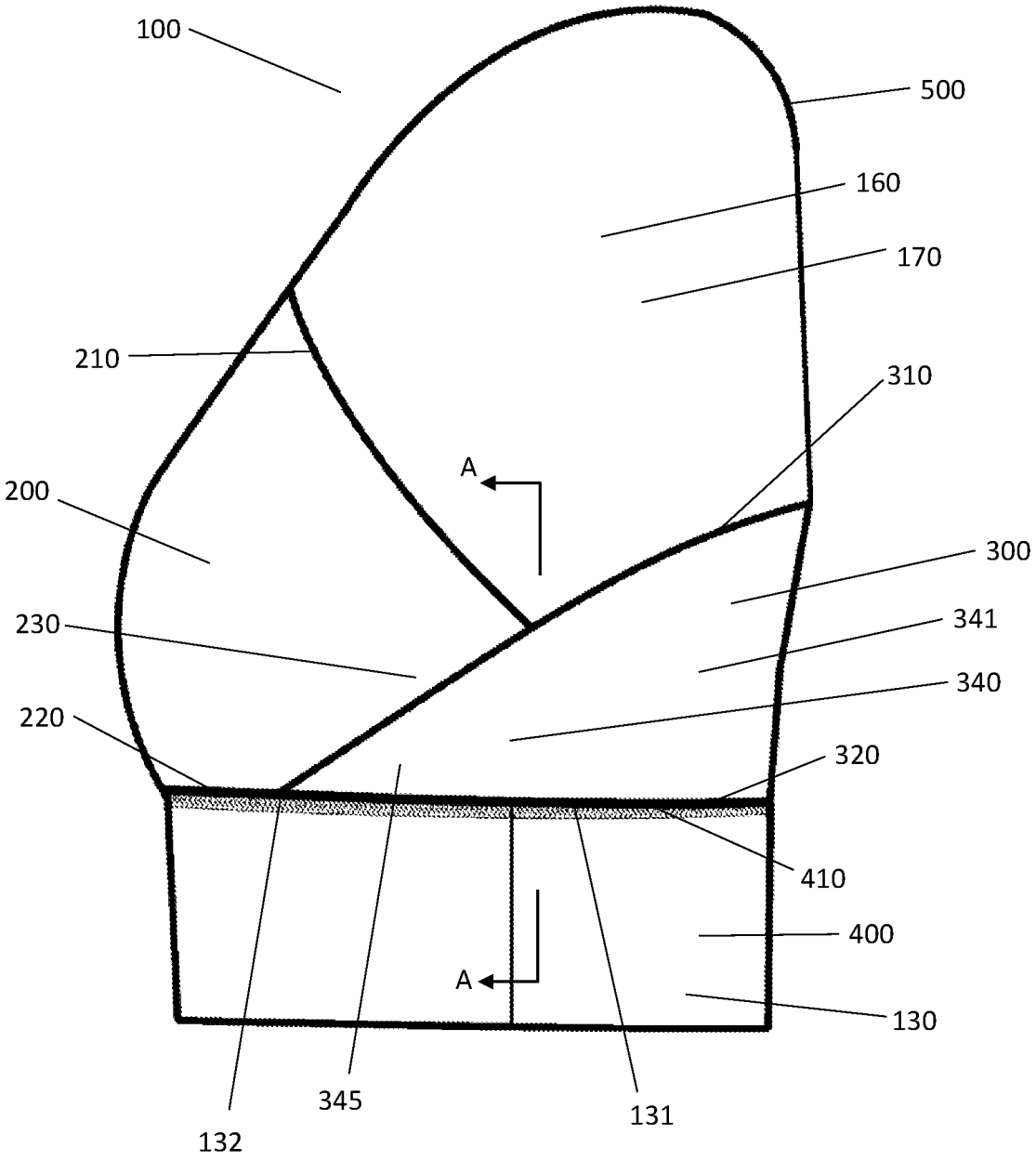
FIG. 3 is a right side view thereof, with the side wing of the garment shown in a raised position for concealing the pocket opening positioned thereunder.
Figure 4:
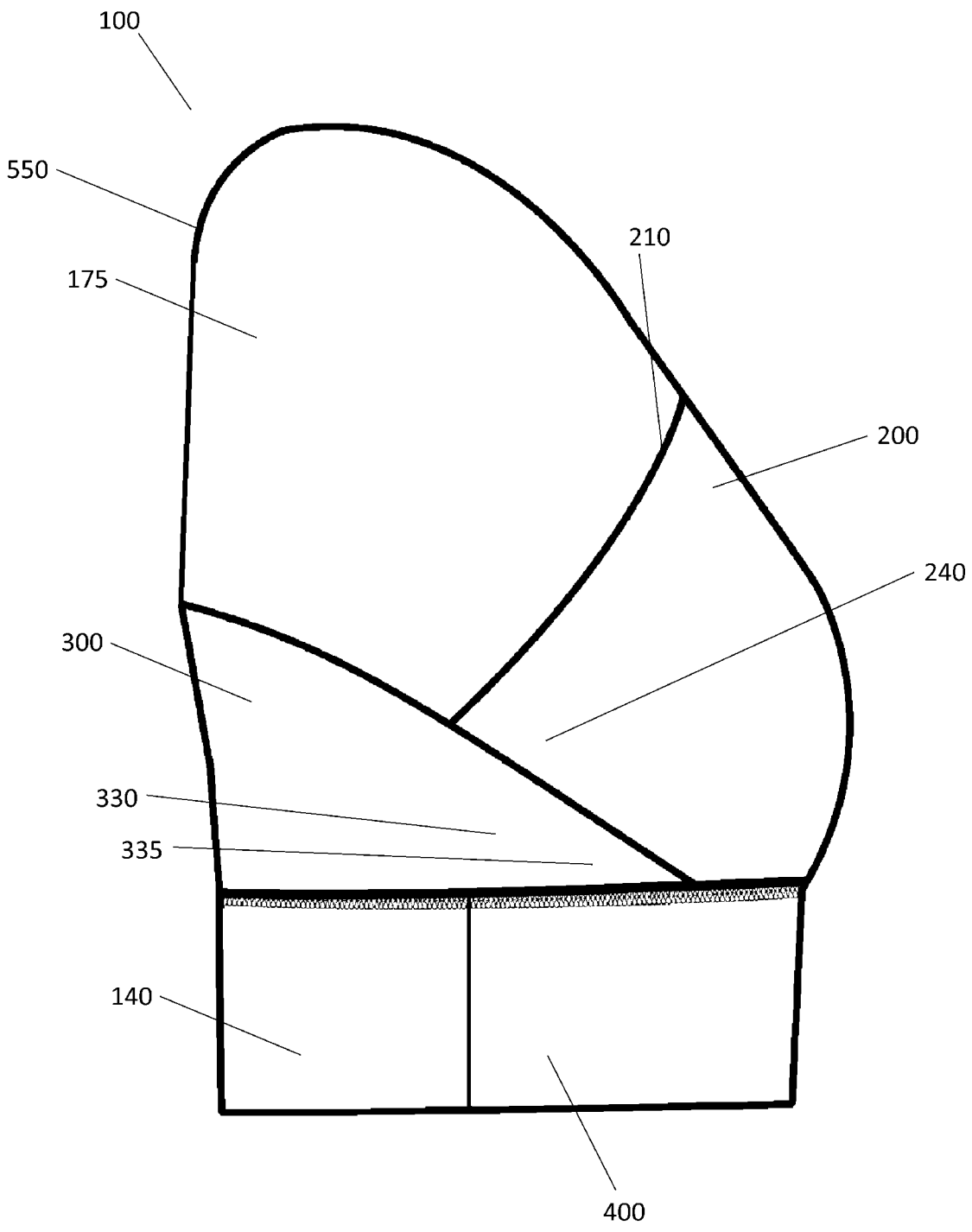
FIG. 4 is a left side view thereof.

FIG. 1 is an outside front view illustrating an example garment 100, such as a bra or sports bra, having cup pockets (e.g., 600) with hidden or concealed pocket openings (e.g., 620). FIG. 2 is a rear view thereof. FIG. 3 is a right side view thereof, with a side wing 340 of the garment 100 shown in a raised position 341 for concealing a pocket opening 620 positioned thereunder. And, FIG. 4 is a left side view thereof. The garment 100 may be a bra, sports bra, bathing suit, bathing suit top, tank top, dress, sports dress, or the like.

As shown in FIGS. 1-4, the garment (e.g., bra) 100 has a front side 110, a back side 120, a first (e.g., right) side 130, a second (e.g., left) side 140, an outside 150, and an inside 160. The bra 100 has a front portion (or fabric portion) 200, a back portion (or fabric portion) 300, an underbust or under band 400, and first (e.g., right) and second (e.g., left) straps 500, 550. The front portion 200 has a top edge 210, a bottom edge 220, a first (e.g., right) side wing 230, and a second (e.g., left) side wing 240. The back portion 300 has a top edge 310, a bottom edge 320, a third (e.g., right) side wing 330, and a fourth (or left) side wing 340. The front portion 200 is for covering a front portion of the wearer's body, the back portion 300 is for covering a back portion of the wearer's body, the first (e.g., right) side wing 230 and the fourth (e.g., left) side wing 340 are for covering a first (e.g., right) side portion of the wearer's body, and the second (e.g., left) side wing 240 and the third (e.g., right) side wing 330 are for covering a second (e.g., left) side portion of the wearer's body.

The first and second straps 500, 550 extend over the shoulders of a wearer from the top edge 210 of the front portion 200 to the top edge 310 of the back portion 300. The straps 500, 550 define first (e.g., right) and second (e.g., left) arm openings 170, 175 and a neck or head opening 180 for the garment 100. Front and back top portions of the first and second straps 500, 550 may be attached (e.g., connected, sewn, glued, bonded, coupled, joined, etc.) along respective top edges thereof proximate the tops of the shoulders of the garment 100.

The under band 400 extends around a waist opening 185 of the garment 100 and is attached (e.g., connected, sewn, glued, bonded, coupled, joined, etc.) along a top edge 410 thereof to the bottom edges 220, 320 of the front and back portions 200, 300.

Figure 5:
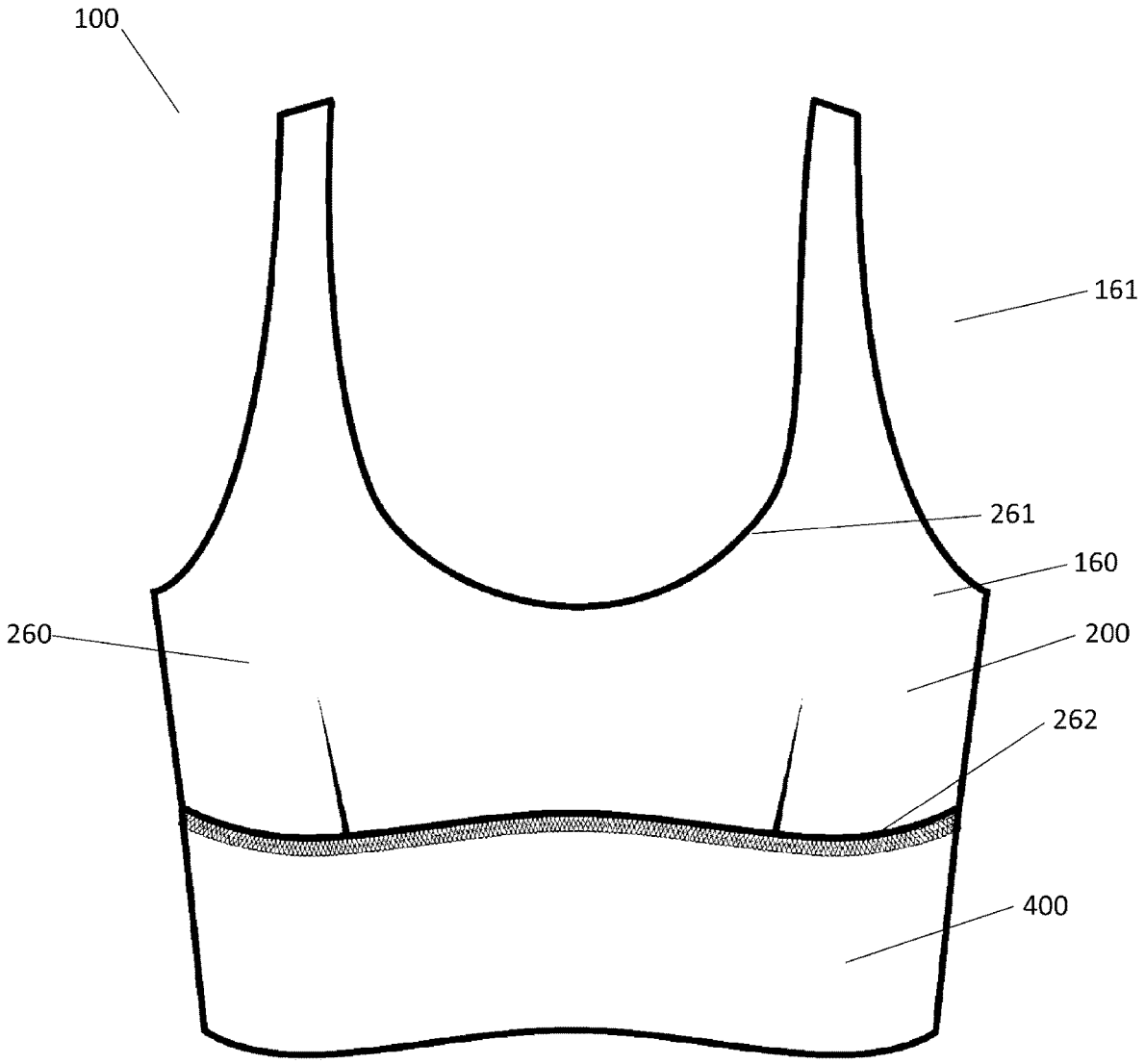
FIG. 5 is an inside front inside view illustrating the garment of FIG. 1.
Figure 6:
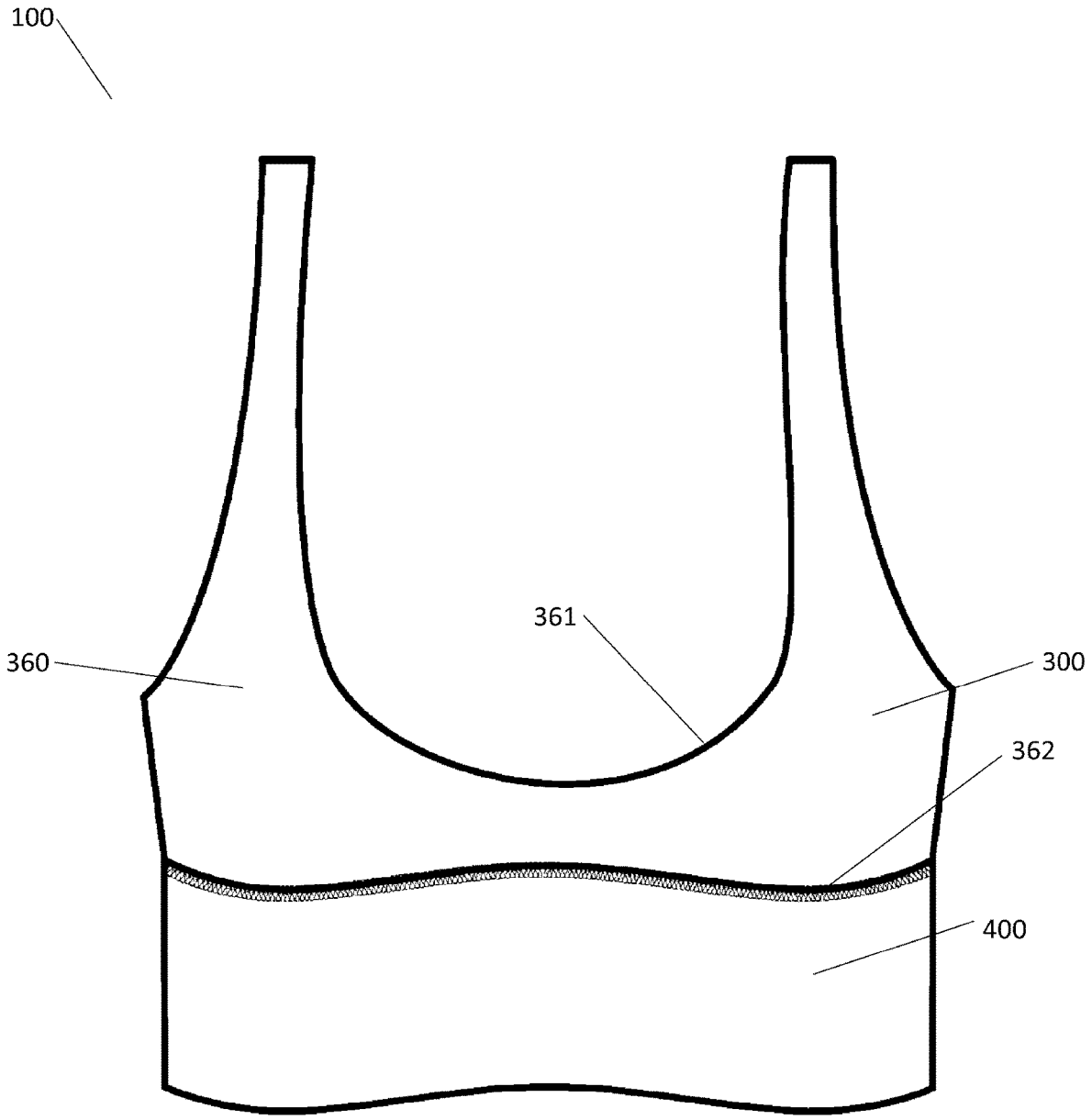
FIG. 6 is a rear view thereof.
Figure 7:
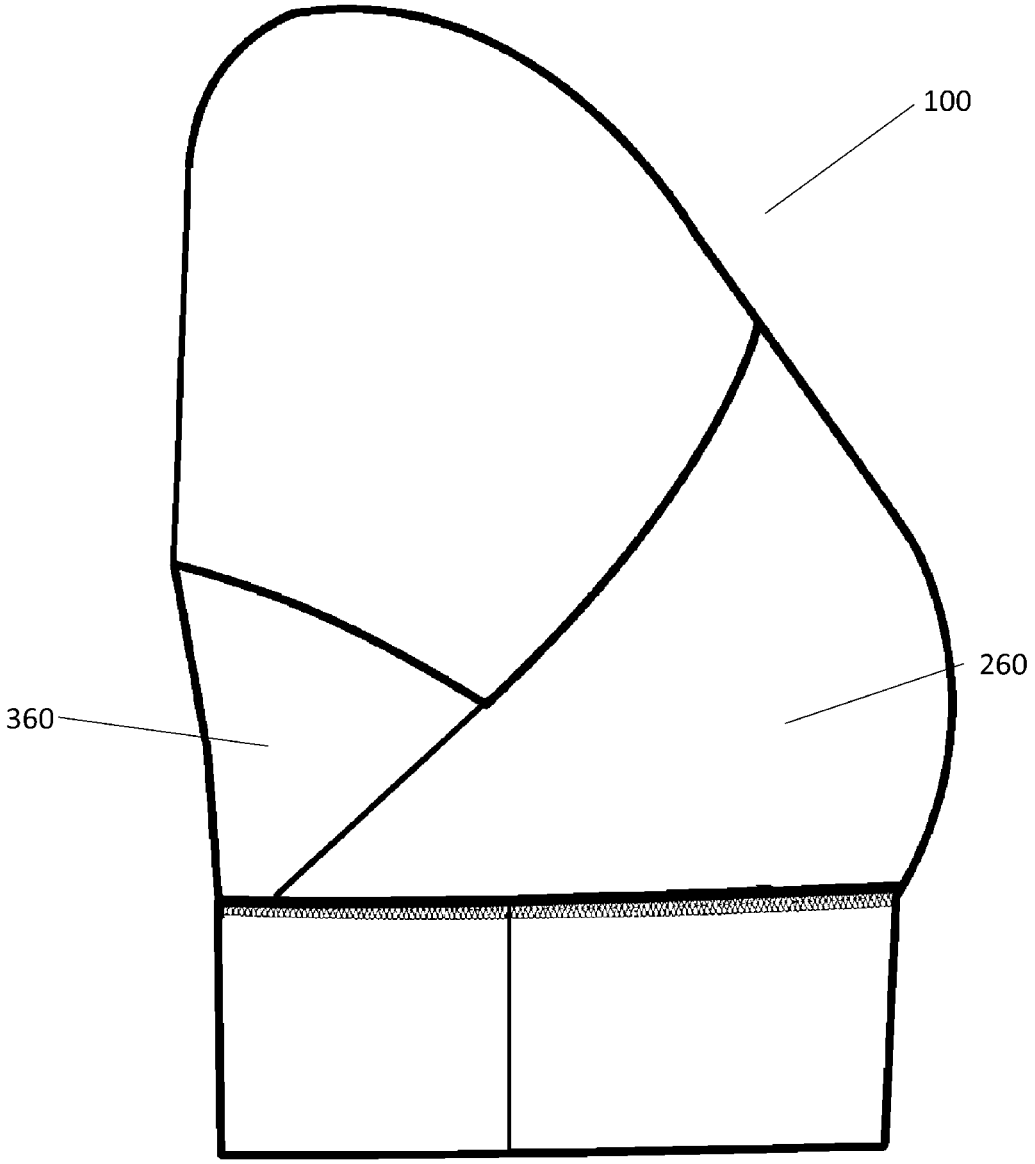
FIG. 7 is right side view thereof.
Figure 8:
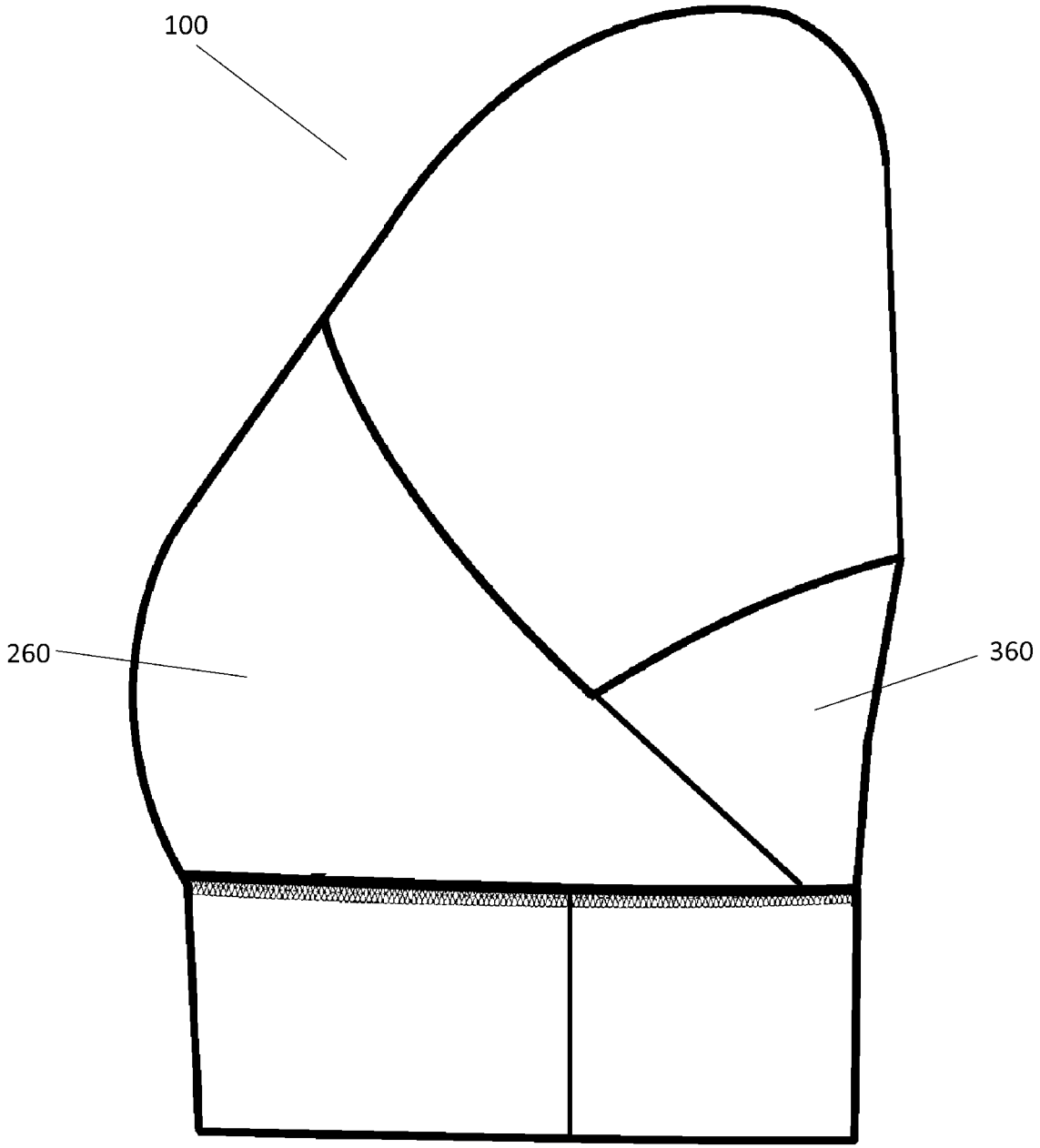
FIG. 8 is a left side view thereof.

FIG. 5 is an inside front view illustrating the example garment 100 of FIG. 1. FIG. 6 is a rear view thereof. FIG. 7 is a right side view thereof. And, FIG. 8 is a left side view thereof.

The front portion 200 has a first (e.g., outer) panel (or fabric panel) 250 having a top edge 251 and a bottom edge 252 and a second (e.g., inner) panel (or fabric panel) 260 having a top edge 261 and a bottom edge 262. The first panel 250 is attached to the second panel 260 along respective top edges 251, 261 and bottom edges 252, 262 forming a pocket bag or space 270 therebetween. The top edges 251, 261 and bottom edges 252, 262 of the first and second panels 250, 260 when attached may form the top and bottom edges 210, 220 of the front portion 200 of the garment 100.

The back portion 300 has a third (e.g., outer) panel (or fabric panel) 350 having a top edge 351 and a bottom edge 352 and a fourth (e.g., inner) panel (or fabric panel) 360 having a top edge 361 and a bottom edge 362. The third panel 350 is attached to the fourth panel 360 along respective top edges 351, 361 and bottom edges 352, 362. The top edges 351, 361 and bottom edges 352, 362 of the third and fourth panels 350, 360 when attached may form the top and bottom edges 310, 320 of the back portion 300 of the garment 100. Alternatively, the back portion 300 may comprise a single panel (e.g., 350) having an inner surface 301 and an outer surface 302.

Figure 9:
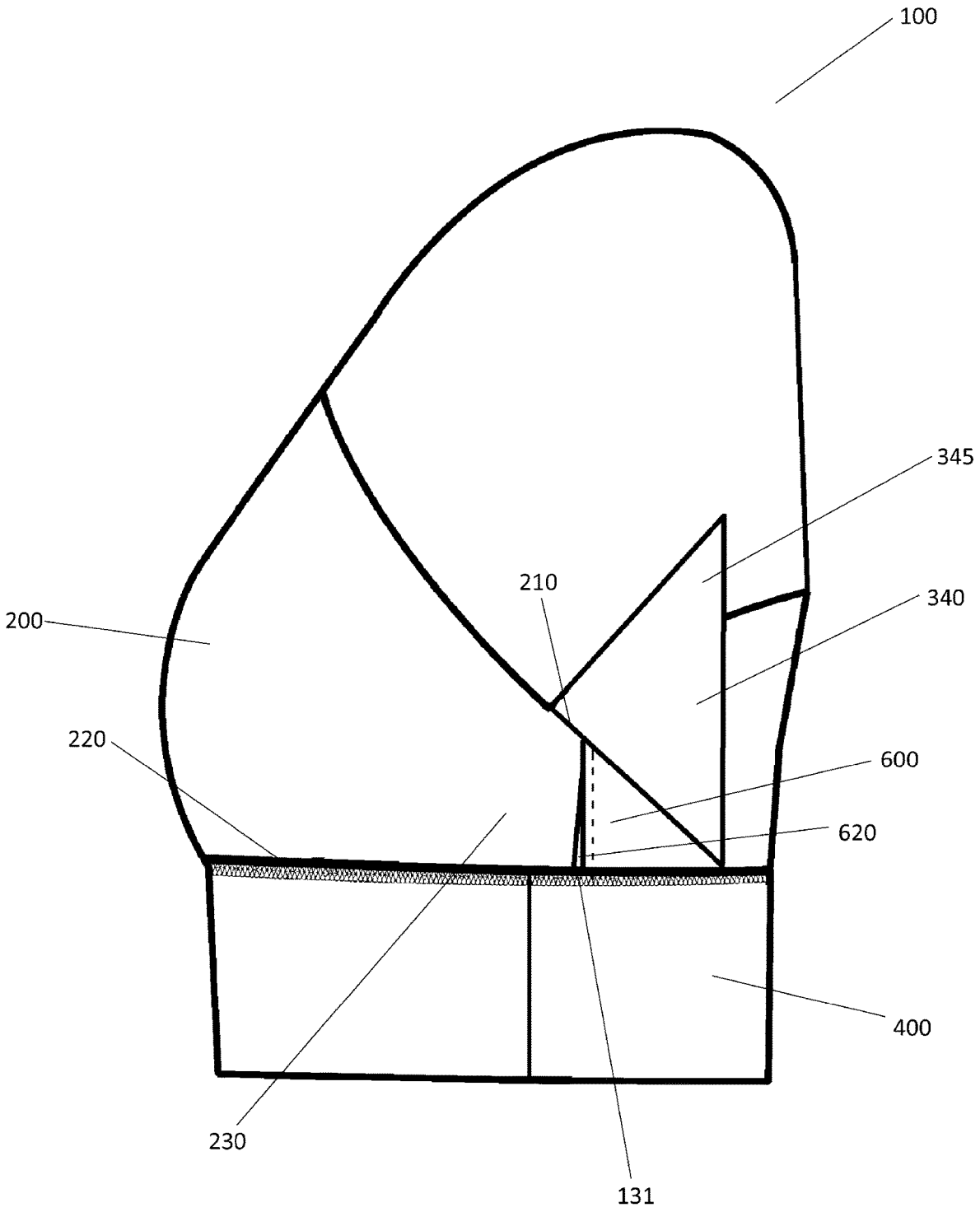
FIG. 9 is a right side view illustrating the garment of FIG. 1 with a portion of the side wing detached from the under band to show the pocket opening positioned thereunder.
Figure 10:
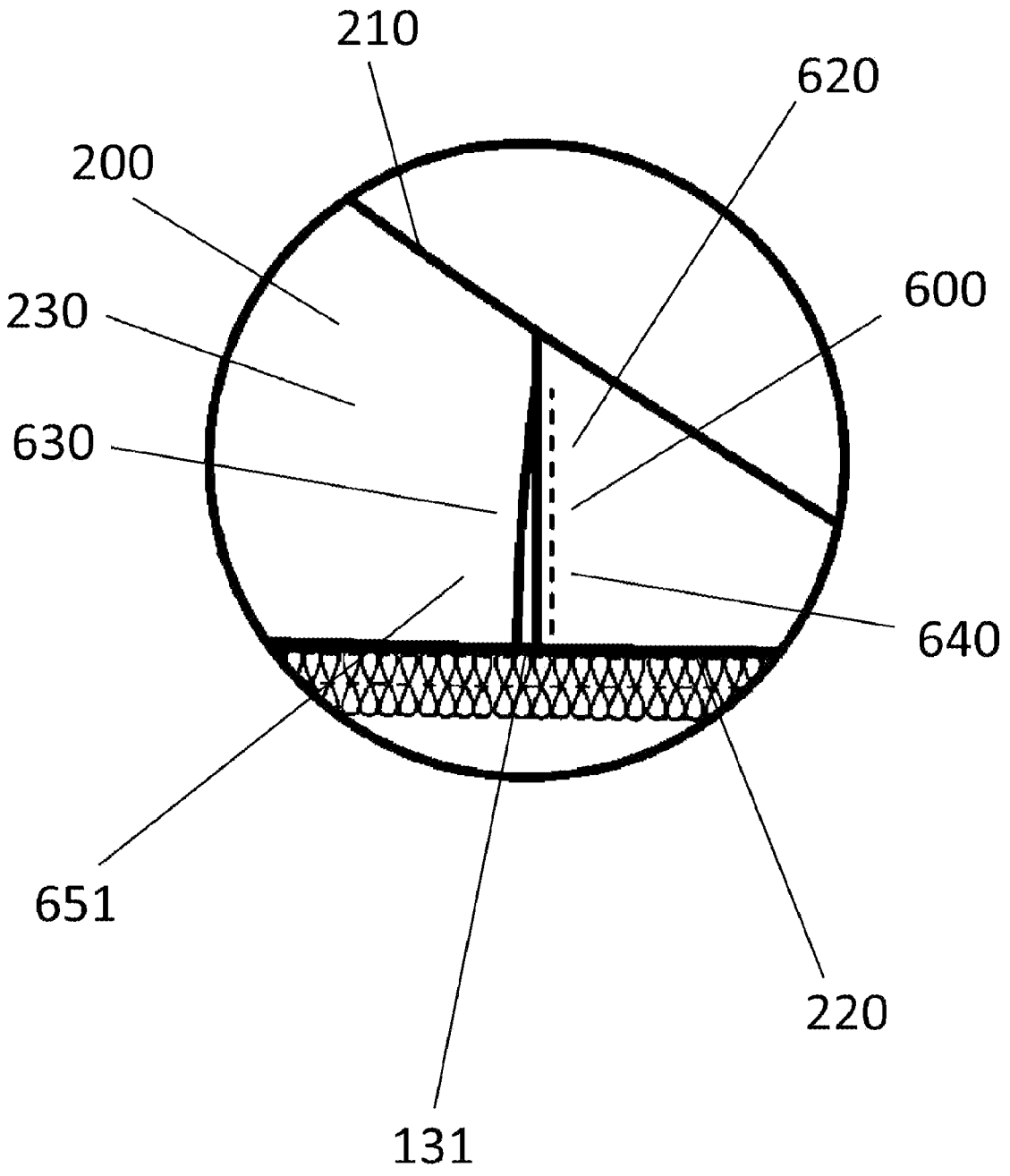
FIG. 10 is right side detail view illustrating the garment of FIG. 1 with the pocket opening shown in a closed position.
Figure 11:
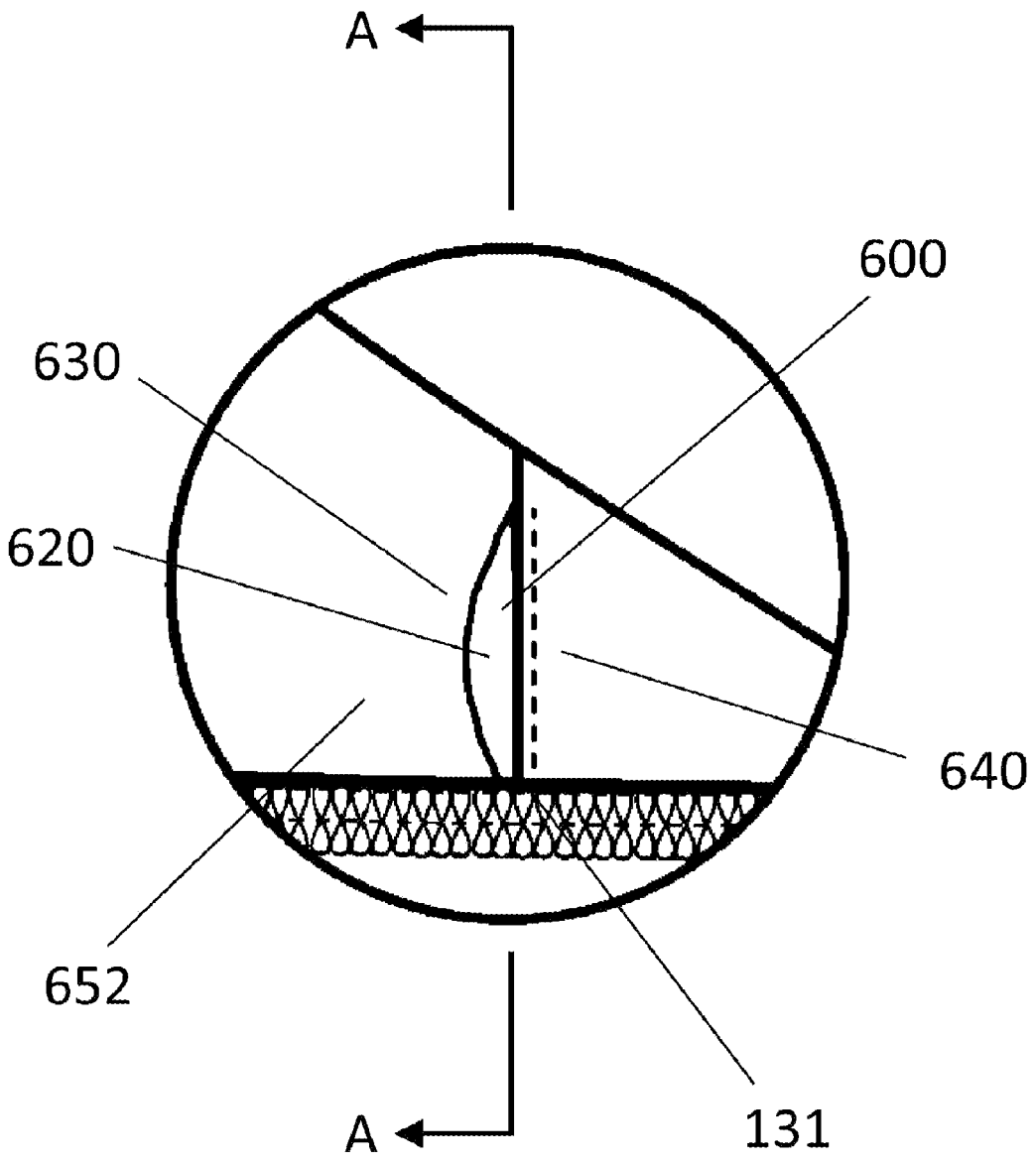
FIG. 11 is a right side detail view illustrating the garment of FIG. 1 with the pocket opening shown in an opened position.
Figure 12:
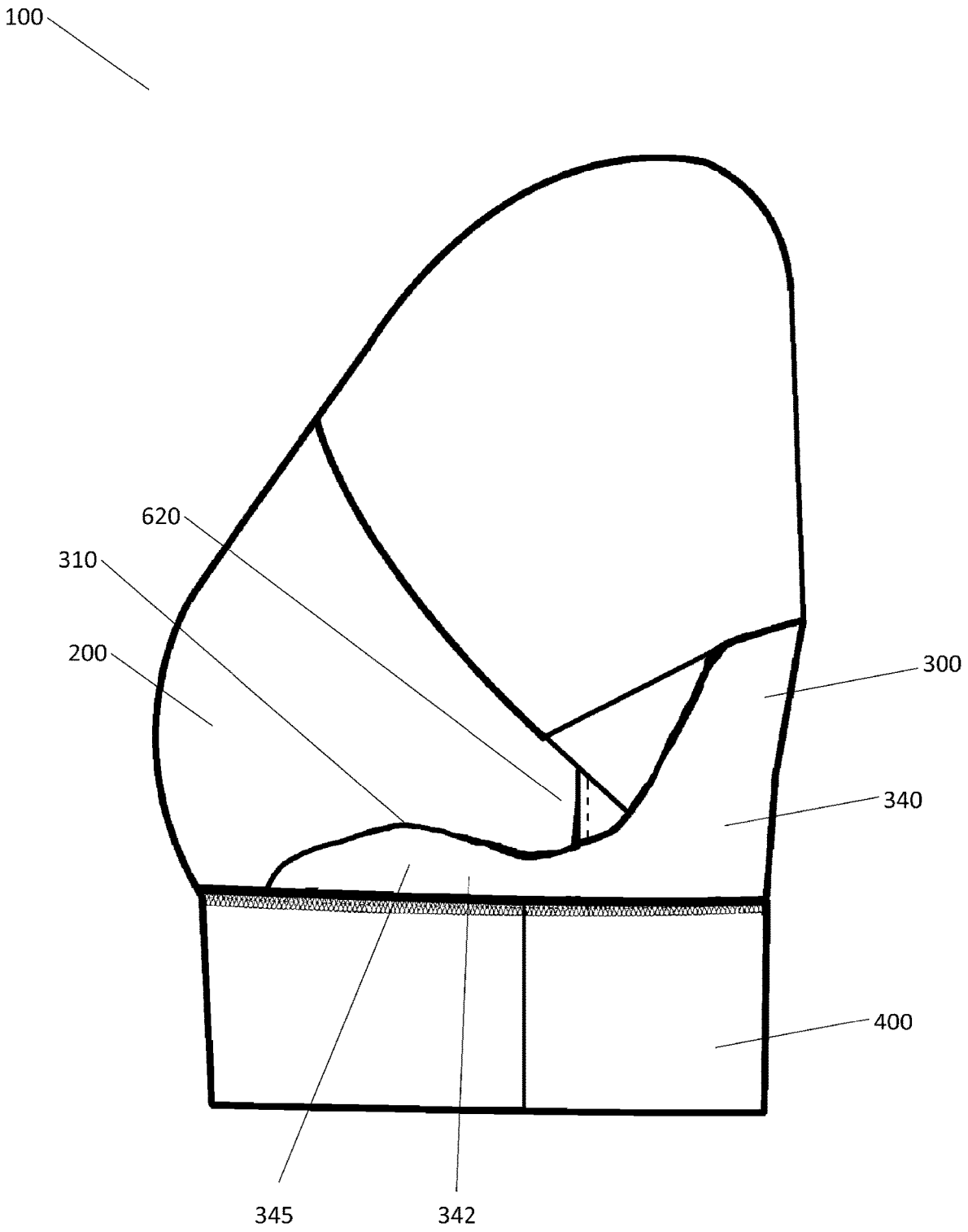
FIG. 12 is a right side view illustrating the garment of FIG. 1 with the side wing of the garment shown in a lowered position for accessing the pocket opening positioned thereunder.
Figure 13:
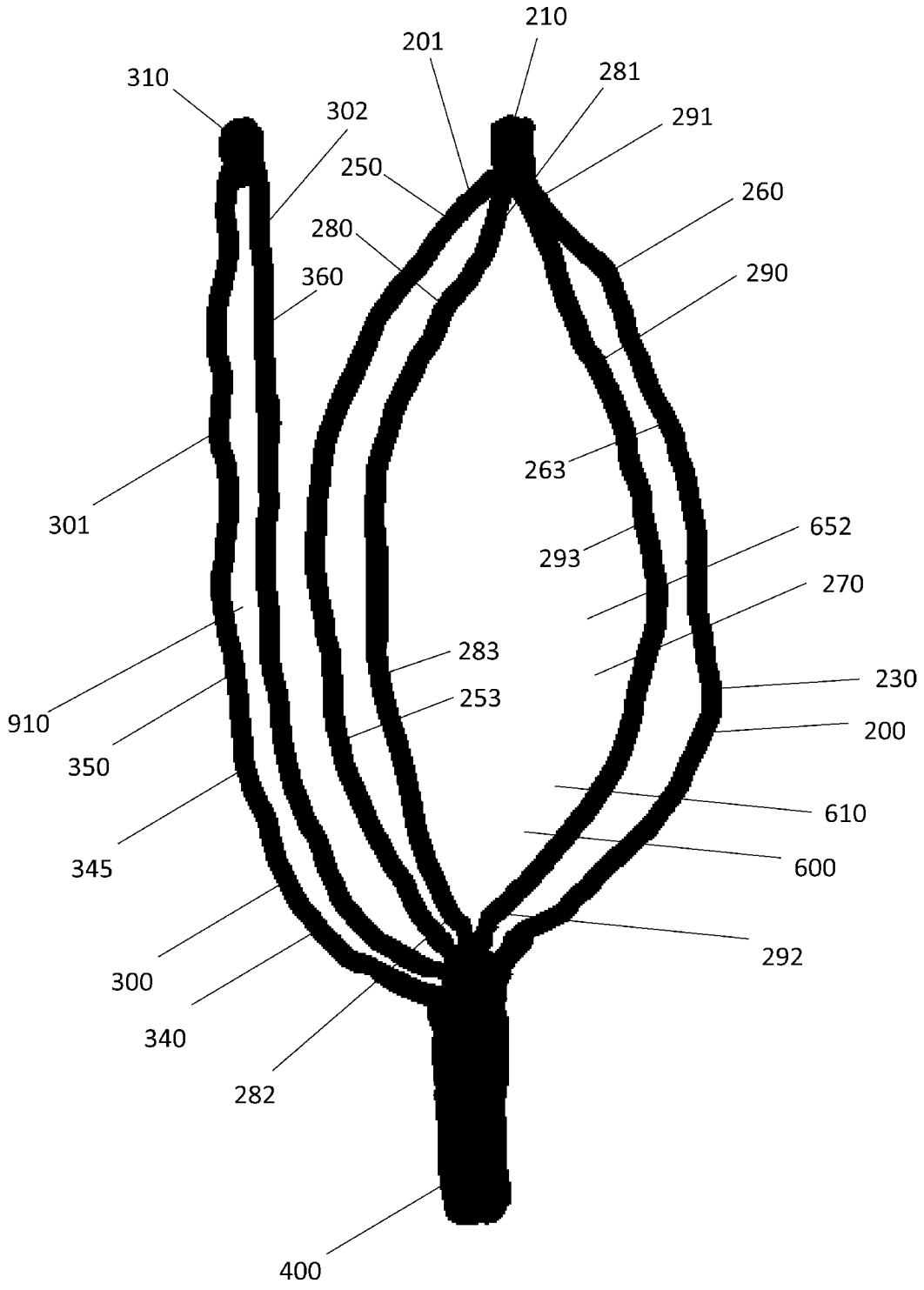
FIG. 13 is a cross-sectional detail view taken along line A-A in FIG. 3.
Figure 14:
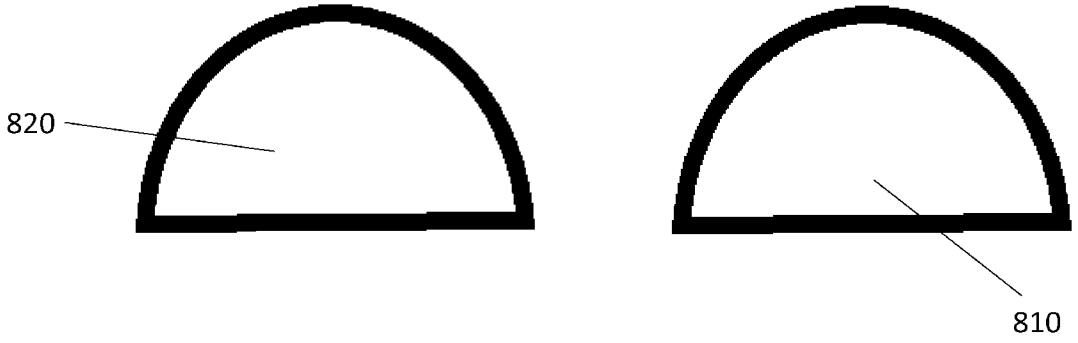
FIG. 14 is a front view illustrating example inserts for inserting into the cup pockets of the garment of FIG. 1.

FIG. 9 is a right side view illustrating the garment 100 of FIG. 1 with a portion 345 of the side wing 340 detached from the under band 400 to show the pocket opening 620 positioned thereunder. FIG. 10 is right side detail view illustrating the garment 100 of FIG. 1 with the pocket opening 620 shown in a closed position 651. FIG. 11 is a right side detail view illustrating the garment 100 of FIG. 1 with the pocket opening 620 shown in an opened position 652. FIG. 12 is a right side view illustrating the example garment 100 of FIG. 1 with the side wing 340 of the garment 100 shown in a lowered position 342 for accessing the pocket opening 620 positioned thereunder. FIG. 13 is a cross-sectional detail view taken along line A-A in FIG. 3. And, FIG. 14 is a front view illustrating example inserts (or cookies) 810, 820 for inserting into the cup pockets 600 of the garment 100 of FIG. 1.

The cup pockets (or pockets) (e.g., 600) are formed in the front portion 200 of the garment 100. The first (e.g., right) cup pocket 600 is shown in FIGS. 10-11 on first (e.g., right) side 130 of the garment 100. The second (e.g., left) cup pocket has a corresponding position and structure on the second (e.g., left) side 140 of the garment 100.

The first and second panels 250, 260 may include first and second panel liners (or fabric liners) 280, 290 (see FIG. 13). The first panel liner 280 is attached to the second panel liner 290 along respective top edges 281, 291 and bottom edges 282, 292 further forming the pocket bag or space 270. The first and second liners 280, 290 may also be attached along a longitudinal center line or axis 275 (see FIG. 1) of the front portion 200 thereby dividing the pocket bag or space 270 into a first (e.g., right) pocket bag or space 610 for a first (e.g., right) cup pocket 600 and a second (e.g., left) pocket bag or space for a second (e.g., left) cup pocket.

A first (e.g., right) pocket opening (or opening) 620 is formed in the first (e.g., right) side wing 230 on the first (e.g., right) side 130 of the garment 100 through the first panel 250 and first panel liner 280 and into the first pocket bag or space 610. The first pocket opening 620 may extend (e.g., vertically or approximately vertically) from the top edge 210 to the bottom edge 220 of the front portion 200. The first pocket opening 620 has a first (or forward facing) pocket edge 630 and a second (or rearward facing) pocket edge 640. The first panel 250 and the first panel liner 280 may be attached along the first and second pocket edges 630, 640 to finish the first cup pocket 600. The first pocket opening 620 and the first pocket bag or space 610 are thus forward facing (i.e., the first pocket bag or space 610 extends toward the front 110 of the garment 100 from the pocket opening 620). The first pocket opening 620 is sized to receive a first insert 810 (or other item) for removably positioning within the first pocket space 610. In one embodiment, the first pocket opening 620 is positioned at a first location 131 on the first side 130 of the garment 100 located approximately midway between the front 110 and the back 120 of the garment 100.

The first pocket opening 620 is hidden or concealed from view (e.g., when the garment 100 is worn) by the fourth (e.g., left) wing 340 of the back portion 300 of the garment 100. In particular, an end or end portion 345 of the fourth wing 340 overlaps the first pocket opening 620. That is, the fourth wing 340 of the back portion 300 overlaps the first wing 230 of the front portion 200 at least to the extent that the first pocket opening 620 is covered by the fourth wing 340 of the back portion 300. In one embodiment, the end portion 345 of the fourth wing 340 extends to a second location 132 on the first side 130 of the garment 100 that is at least further toward the front 110 of the garment 100 than the first location 131 of the first pocket opening 620, thus covering or overlapping the first pocket opening 620.

The first (or forward facing) pocket edge 630 is moveable from a closed position 651 (see FIG. 10) in which the first pocket opening 620 into the first pocket space or bag 610 of the first cup pocket 600 is collapsed or closed to an opened position 652 (see FIG. 11) in which the first (or forward facing) pocket edge 630 of the first pocket space or bag 610 of the first cup pocket 600 is expanded or opened 652, by a wearer inserting an item (e.g., an insert 810) or finger into the cup pocket 600 between the first (or forward facing) and the second (or backward facing) pocket edges 630, 640 and pulling or stretching the first (or forward facing) pocket edge 630 away from the second (or backward facing) pocket edge 640. In the opened position 652, at least a portion of the inner side 253, 283 of first panel 250 and/or the first panel liner 280 proximate the first (or forward facing) pocket edge 630 is separated from the inner side 263, 293 of the second panel 260 and/or second panel liner 290 expanding the first pocket opening 620 through which items (e.g., 810) may be inserted into the first pocket space or bag 610 of the first cup pocket 600.

The first (or forward facing) pocket edge 630 is moveable from the opened position 652 in which the first pocket opening 620 is expanded or opened 652 to the closed position 651 in which the first pocket opening 620 is collapsed or closed 651, by a wearer removing an item (e.g., an insert 810) or finger from the first pocket space or bag 610 of the first cup pocket 600 between the first (or forward facing) and the second (or backward facing) pocket edges 630, 640 and allowing the first (or forward facing) pocket edge 630 to move toward and contact the second (or backward facing) pocket edge 640 to close the first pocket opening 620 into the first pocket space or bag 610 of the first cup pocket 600. In the closed position 651, at least a portion of the inner side 253, 283 of the first panel 250 and/or first panel liner 280 proximate the first (or forward facing) pocket edge 630 is adjacent to or in contact with the inner side 263, 293 of the second panel 260 and/or second panel liner 290 closing the first pocket opening 620 into the first pocket space or bag 610 of the first cup pocket 600.

In addition, the end portion 345 of the fourth wing 340 of the back portion 300 is moveable from a raised or closed position 341 (see FIG. 3) in which the first pocket opening 620 is hidden or concealed (and is inaccessible) to a lowered or opened position 342 (see FIG. 12) in which the first pocket opening 620 is uncovered or revealed (and is accessible) 342, by a wearer inserting an item (e.g., an insert 810) or finger into the gap 910 (see FIG. 13) between the surface (e.g., the outer surface) 201 of the front portion 200 and the surface (e.g., the inner surface) 302 of the back portion 300 proximate the first pocket opening 620 on the first side 130 of the garment 100 and pulling or stretching the top edge 310 of the end portion 345 away from the outer surface 201 of the front portion 200. In the lowered or opened position 342, at least a portion of the inner surface 302 (i.e., of the upper edge 310) of the end portion 345 is separated from the outer surface 201 (e.g., of the upper edge 210) of the front portion 200 expanding the gap 910 through which items (e.g., 810) may be inserted into the first pocket opening 620 of the first cup pocket 600.

The end portion 345 of the fourth wing 340 is moveable from the lowered or opened position 342 in which the first pocket opening 620 is uncovered or revealed (and is accessible) 342 to the raised or closed position 341 in which the first pocket opening 620 is hidden or concealed (and is inaccessible) 341, by a wearer removing an item (e.g., an insert 810) or finger from the gap 910 between the outer surface 201 of the front portion 200 and the inner surface 302 of the back portion 300 proximate the first pocket opening 620 on the first side 130 of the garment 100 and allowing the top edge 310 of the end portion 345 to move toward and contact the outer surface 201 of the front portion 200. In the raised or closed position 341, at least a portion of the inner side 302 (i.e., of the upper edge 310) of the end portion 345 is adjacent to or in contact with the outer surface 201 (e.g., of the upper edge 210 of the front portion 200) closing or collapsing the gap 910, thereby preventing items (e.g., 810) from being inserted into the first pocket opening 620 of the first cup pocket 600.

In one embodiment, the garment 100 is reversible, that is, the garment 100 may be worn right-side-out (or outside-out) or inside-out. In FIGS. 1-4, the garment 100 is shown in a nominal right-side-out (or outside-out) position or configuration 151. In FIGS. 5-8, the garment 100 is shown in a nominal inside-out position or configuration 161. When worn right-side-out, the first panel 250 of the front portion 200 is an outer panel or layer and the second panel 260 of the front portion 200 is an inner panel or layer. Similarly, the first panel 350 of the back portion 300 is an outer panel or layer and the second panel 360 of the back portion is an inner panel or layer of the back portion 300. When worn inside-out, the first panel 250 of the front portion 200 is an inner panel or layer and the second panel 260 of the front portion 200 is an outer panel or layer. Similarly, the first panel 350 (or the outer surface 301 of the single panel 350 back portion 300) of the back portion 300 is an inner panel or layer and the second panel 360 (or the inner surface 302 of the single panel 350 back portion 300) of the back portion 300 is an outer panel or layer of the back portion 300. When the garment 100 is worn in its inside-out configuration 161, the first side wing 230 of the front portion 200 overlaps the fourth side wing 340 of the back portion 300 (see FIG. 8) hiding the first pocket opening 620 that is on the now inner panel 250 of the now second side 130. To access the first pocket opening 620, the wearer may pull outwardly on the first side wing 230 to move it away from the fourth side wing 340. Similarly, and as shown in FIG. 7, the second side wing 240 of the front portion 200 overlaps the third side wing 330 of the back portion 300 hiding the second pocket opening (i.e., when the garment 100 is worn in its inside-out configuration 161).

In one embodiment, the first portion, second portion, first panel, second panel, third panel, fourth panel, and straps 200, 300, 250, 260, 350, 360 of the garment 100 may be made from or include a stretchable, clastic fabric such as Nulux™, Lycra™, Luxtreme™, Luon™, spandex, elastane, or the like. The first and second liners 280, 290 may be made from or include a breathable, stretchable fabric such as Power Mesh™, or the like.

In operation, a wearer puts on the garment 100 by inserting their arms and head though the waist opening 185 and into the respective arm and neck openings 170, 175, 180 of the garment 100 and then by pulling on the under band 400 and straps 500, 550 to adjust the positioning of the garment 100 over the wearer's chest, back, and shoulders. Lateral tension within the side wings 230, 240, 330, 340 and under band 400 when the garment 100 is worn functions to draw or stretch the top edges 210, 310 of the side wings 230, 240, 330, 340 together to close the gaps (e.g., 910) between the first and fourth side wings 230, 340 and between the second and third side wings 240, 330 and maintain the end portions 335, 345 of the third and fourth wings 330, 340 in the raised or closed position 341. Similarly, longitudinal tension within the first and second side wings 230, 240 when the garment 100 is worn functions to draw or stretch the first and second pocket edges (e.g., 630, 640) of the first and second side wings 230, 240 together to close the first and second pocket openings (e.g., 620) and maintain the first and second cup pockets (e.g., 600) in the closed position 651. Inserts 810, 820 may be inserted into or removed from the pocket spaces or bags (e.g., 610) of the cup pockets 600 by the wearer inserting an item (e.g., an insert 810) or finger into the gaps 910 and pulling of stretching the top edges 310 of the end portions 335, 345 of the back portion 300 away from the outer surface 201 of the front portion 200 to uncover or reveal (and make accessible) the first and second pocket openings 620. Then, the wearer may continue by inserting the item (i.e., the insert 810) or finger into the cup pockets 600 between the first and the second pocket edges 630, 640 and pulling or stretching the first pocket edge 630 away from the second pocket edge 640 to open the first and second pocket openings 620 allowing the items to be positioned within the first and second pocket spaces or bags 610 of the first and second cup pockets 600.

Advantageously, the cup pockets (e.g., 600) of the garment 100 allow a wearer to easily position inserts 810, 820 in the first portion 200 of the garment 100 and maintain the inserts 810, 820 securely in place during stretching, exercising, and athletic performance. In addition, the concealed pocket openings (e.g., 620) improve the visual appeal of the garment 100. Furthermore, the concealed pocket openings 620 allow the garment 100 to be worn right-side-out 151 or inside-out 161 without detracting from the visual appeal of the garment 100.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this application are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Any example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A garment, comprising:

a front portion having a top edge, a bottom edge, a first side wing, and a second side wing, the front portion having a first panel and a second panel positioned adjacent thereto, the first panel attached to the second panel at least along the top edge of the front portion to form a pocket space between the first and second panels of the front portion;

a back portion having a top edge, a bottom edge, a third side wing, and a fourth side wing;

a first pocket opening formed in the first side wing and opening into the pocket space; and, a second pocket opening formed in the second side wing and opening into the pocket space;

wherein the first and second side wings extend from a respective side of the garment to a respective portion of the back portion of the garment and the third and fourth side wings extend from a respective side of the garment to a respective portion of the front portion of the garment;

wherein the garment is reversible, being able to be worn outside-out or inside-out; and, wherein, when the garment is worn outside-out or inside-out, the fourth side wing at least partially overlaps the first pocket opening on the first side wing thereby concealing the first pocket opening and the third side wing at least partially overlaps the second pocket opening on the second side wing thereby concealing the second pocket opening.

2. The garment of claim 1, wherein, when the garment is worn outside-out, the first and second openings face away from a wearer.

3. The garment of claim 1, wherein, when the garment is worn inside-out, the first and second openings face toward a wearer.

4. The garment of claim 1, wherein the back portion further comprises a third panel and a fourth panel positioned adjacent thereto, the third panel attached to the fourth panel at least along the top edge of the back portion.

5. The garment of claim 1, further comprising a first insert configured to be removably positioned in the pocket space through the first pocket opening and a second insert configured to be removably positioned in the pocket space through the second pocket opening when the garment is worn outside-out or inside-out.

6. The garment of claim 5, wherein the first panel and the second panel each further comprise respective first and second panel liners, wherein the first panel liner is attached to the second panel liner along a longitudinal center line or axis of the front portion dividing the pocket space and forming a first pocket space and a second pocket space.

7. The garment of claim 6, wherein the first insert is removably positioned in the first pocket space and the second insert is removably positioned in the second pocket space.

8. The garment of claim 1, further comprising an under band attached to the bottom edges of the front and back portions.

9. The garment of claim 1, wherein the first and the second pocket openings are accessible via respective gaps formed between unattached top edges of the first and fourth side wings and between unattached top edges of the second and the third side wings when the garment is worn outside-out or inside-out.

10. The garment of claim 1, wherein the respective top edges of the third and fourth side wings of the back portion are inclined with respect to the bottom edge of the back portion when the garment is worn outside-out or inside-out.

11. The garment of claim 1, wherein the first and second openings are vertical or approximately vertical with respect to the bottom edge of the front portion when the garment is worn outside-out or inside-out.

12. The garment of claim 1, wherein the fourth side wing overlaps the first pocket opening on the first side wing thereby concealing the first pocket opening and the third side wing overlaps the second pocket opening on the second side wing thereby concealing the second pocket opening when the garment is worn outside-out or inside-out.

13. The garment of claim 1, wherein the garment is a bra, a sports bra, a bathing suit, a bathing suit top, a dress, a sports dress, or a tank top.

14. A garment, comprising:

a front portion having a top edge, a bottom edge, a first side wing, and a second side wing, the front portion having a first panel and a second panel positioned adjacent thereto, the first panel attached to the second panel at least along the top edge of the front portion to form a pocket space between the first and second panels of the front portion;

a back portion having a top edge, a bottom edge, a third side wing, and a fourth side wing;

a first pocket opening formed in the first side wing and opening into the pocket space;

a second pocket opening formed in the second side wing and opening into the pocket space; and, a first insert configured to be removably positioned in the pocket space through the first pocket opening and a second insert configured to be removably positioned in the pocket space through the second pocket opening when the garment is worn outside-out or inside-out;

wherein the first and second side wings extend from a respective side of the garment to a respective portion of the back portion of the garment and the third and fourth side wings extend from a respective side of the garment to a respective portion of the front portion of the garment.

15. The garment of claim 14, wherein the first panel and the second panel each further comprise respective first and second panel liners, wherein the first panel liner is attached to the second panel liner along a longitudinal center line or axis of the front portion dividing the pocket space and forming a first pocket space and a second pocket space.

16. The garment of claim 15, wherein the first insert is removably positioned in the first pocket space and the second insert is removably positioned in the second pocket space.

17. The garment of claim 14, wherein the garment is reversible, being able to be worn outside-out or inside-out.

18. The garment of claim 17, wherein, when the garment is worn outside-out or inside-out, the fourth side wing at least partially overlaps the first pocket opening on the first side wing thereby concealing the first pocket opening and the third side wing at least partially overlaps the second pocket opening on the second side wing thereby concealing the second pocket opening.

19. The garment of claim 17, wherein the first and the second pocket openings are accessible via respective gaps formed between unattached top edges of the first and fourth side wings and between unattached top edges of the second and the third side wings when the garment is worn outside-out or inside-out.

20. The garment of claim 14, wherein the garment is a bra, a sports bra, a bathing suit, a bathing suit top, a dress, a sports dress, or a tank top.

* * * * *